US010655409B2

(12) United States Patent
Xue et al.

(10) Patent No.: US 10,655,409 B2
(45) Date of Patent: May 19, 2020

(54) SENSOR OPTIMIZATION FOR MUD CIRCULATION SYSTEMS

(71) Applicant: Halliburton Energy Services, Inc., Houston, TX (US)

(72) Inventors: Yuzhen Xue, Humble, TX (US); Jason D. Dykstra, Spring, TX (US); Xiaoqing Ge, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 382 days.

(21) Appl. No.: 15/323,822

(22) PCT Filed: Jul. 13, 2016

(86) PCT No.: PCT/US2016/042014
§ 371 (c)(1),
(2) Date: Jan. 4, 2017

(87) PCT Pub. No.: WO2017/011514
PCT Pub. Date: Jan. 19, 2017

(65) Prior Publication Data

US 2017/0204691 A1 Jul. 20, 2017

Related U.S. Application Data

(60) Provisional application No. 62/191,854, filed on Jul. 13, 2015.

(51) Int. Cl.
*E21B 21/08* (2006.01)
*E21B 21/06* (2006.01)
(Continued)

(52) U.S. Cl.
CPC ..... *E21B 21/08* (2013.01); *E21B 21/065* (2013.01); *E21B 47/00* (2013.01); *E21B 49/08* (2013.01)

(58) Field of Classification Search
CPC ..... E21B 21/01; E21B 21/08
See application file for complete search history.

(56) References Cited

U.S. PATENT DOCUMENTS 5,019,978 A * 5/1991 Howard, Jr. ..... E21B 47/04 702/6
2005/0194183 A1 9/2005 Gleitman et al.
(Continued)

FOREIGN PATENT DOCUMENTS

WO 2014031499 A1 2/2014

OTHER PUBLICATIONS

Brunton, et al., "Optimal Sensor Placement and Enhanced Sparsity for Classification," Oct. 15, 2013, 13 pages, obtained from https://arxiv.org/pdf/1310.4217.pdf.
(Continued)

*Primary Examiner* — Tara E Schimpf
(74) *Attorney, Agent, or Firm* — Gilliam IP PLLC

(57) ABSTRACT

Methods and systems for enhancing workflow performance in the oil and gas industry may include modeling preferred sensor locations, sensor types, and sampling frequency for effective and efficient monitoring of a mud circulation system. For example, a method may include circulating a mud through a mud circulation system that includes a plurality of sensors that include at least one of: a pressure sensor, a stroke counter, a flow sensor, a viscosity sensor, or density sensor; and modeling the plurality of sensors using a state reduction approach to determine at least one selected from the group consisting of preferred locations, preferred sensory types, preferred sensor frequency resolution, and a combination thereof that effectively represent or substantially impact conditions of the mud circulation system, thereby providing a preferred sensor scheme.

20 Claims, 5 Drawing Sheets

(51) Int. Cl.
*E21B 47/00* (2012.01)
*E21B 49/08* (2006.01)

(56) References Cited

U.S. PATENT DOCUMENTS

| | | | | |
|---|---|---|---|---|
| 2009/0174402 | A1 | 7/2009 | Rottengatter et al. | |
| 2009/0294174 | A1 | 12/2009 | Harmer et al. | |
| 2010/0040281 | A1 | 2/2010 | Chen et al. | |
| 2010/0076785 | A1 | 3/2010 | Mehta et al. | |
| 2013/0135114 | A1* | 5/2013 | Ringer | E21B 47/12 340/855.7 |
| 2013/0218499 | A1 | 8/2013 | Lemer et al. | |
| 2014/0029382 | A1 | 1/2014 | Donderici et al. | |
| 2014/0077964 | A1 | 3/2014 | Beligere et al. | |

OTHER PUBLICATIONS

ISR/WO for PCT/US2016/042014 dated Oct. 14, 2016.

* cited by examiner

SENSOR OPTIMIZATION FOR MUD CIRCULATION SYSTEMS

BACKGROUND

In a mud circulation system, a plurality of sensors may be implemented for sensing mud properties at the surface and downhole. The sensors may include pressure sensors, stroke counters, flow sensors, viscosity sensors, density sensors, and the like at multiple surface and downhole locations. Many sensors including viscosity sensors and the various sensors designed to be implemented downhole are expensive. Additionally, as more sensors are added to a mud circulation system, the amount of data collected, the required communication bandwidth, and the processing power to analyze the data may grow exponentially.

BRIEF DESCRIPTION OF THE DRAWINGS

The following figures are included to illustrate certain aspects of the embodiments, and should not be viewed as exclusive embodiments. The subject matter disclosed is amenable to considerable modifications, alterations, combinations, and equivalents in form and function, as will occur to those skilled in the art and having the benefit of this disclosure.

Figure 1A:
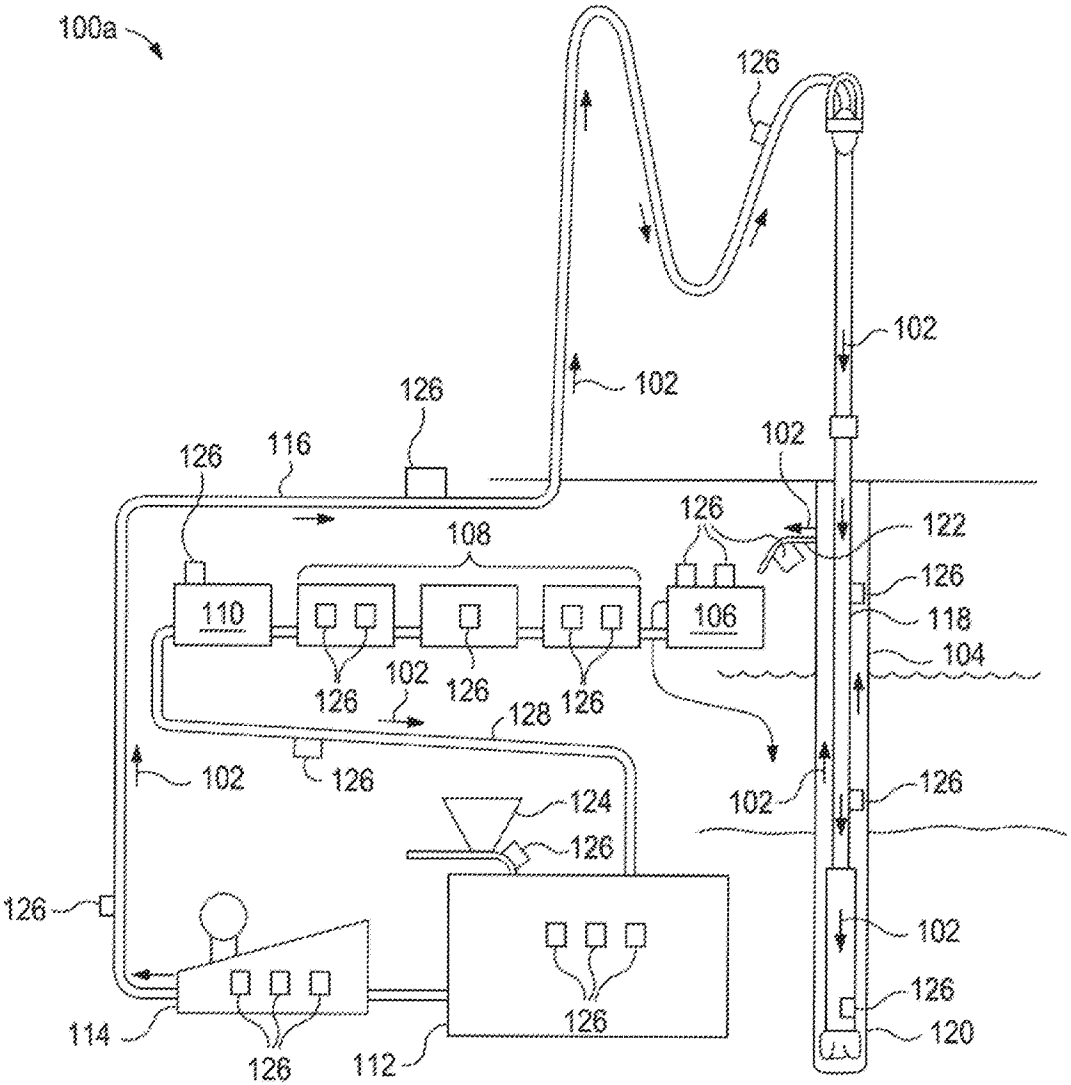
FIGS. 1A and 1B illustrate the same mud circulating system 100*a*,100*b* with different sensor placement.

It should be understood, however, that the specific embodiments given in the drawings and detailed description thereto do not limit the disclosure. On the contrary, they provide the foundation for one of ordinary skill to discern the alternative forms, equivalents, and modifications that are encompassed together with one or more of the given embodiments in the scope of the appended claims.

DETAILED DESCRIPTION

Disclosed herein are methods and systems for enhancing workflow performance in the oil and gas industry. More specifically, the present application relates to modeling preferred sensor locations, sensor types, and sampling frequency for effective and efficient monitoring of a mud circulation system.

As used herein, the term "sensor type" refers to the type of measurement the sensor makes (e.g., pressure, temperature, flow rate, and the like). As used herein, the term "sampling frequency" refers to the frequency with which a sensor takes a measurement. As used herein, the term "sensing scheme" refers generally to a combination of sensor locations, sensor types, and sampling frequency.

The models and methods described herein output preferred sensing schemes for monitoring of a mud circulation system, which may result in a reduced or minimal number of sensors and a reduced or minimal communication/computing load. In some embodiments, monitoring the mud circulation system may involve monitoring mud fluid properties (e.g., density, viscosity, equivalent circulating density (ECD), pressure, lubricity, pH, solids content, gel strength, Alkalinity, filtrate, volumetric flow rate and the like) at specific locations and/or throughout the mud circulation system.

Additionally, the methods and systems described herein may model redundant sensors in preferred locations to increase the confidence in the diagnostics performed. For example, the preferred sensors types may be determined not only by function (e.g., viscosity, pressure, etc.) and location but also according to cost, measurement accuracy, and diagnostic constraints.

The models and methods described herein for determining preferred sensing schemes of a mud circulation system may be implemented when designing a drilling operation in a drilling model program. Additionally, in some instances, during a drilling operation with a given sensing scheme (which may or may not have been modeled to during the designing step to have preferred sensor locations, sensor types, and sampling frequency), the real-time data may be input into a model described herein to propose changes to the sensing scheme to more efficiently and effectively monitor of the mud circulation system.

Compared to sensing the entire of mud circulation system with sensors placed at specific intervals or specific locations based on tradition as is presently the standard practice, the sensing schemes described herein allow for collecting data from a considerably reduced amount of locations, sensor types, and sampling frequency by modeling three types of resolution: spatial resolution, variable resolution, and frequency resolution, respectively.

Modeling Spatial Resolution

Modeling the spatial resolution identifies the preferred locations to install the sensors such that the overall system information/dynamics can be represented in the most efficient way (i.e., locations that effectively represent and/or substantially impact the mud circulation system). Modeling the spatial resolution may be achieved with a state reduction approach to measure the fluid dynamics of whole mud circulating system with the least number of sensors.

Figure 1B:
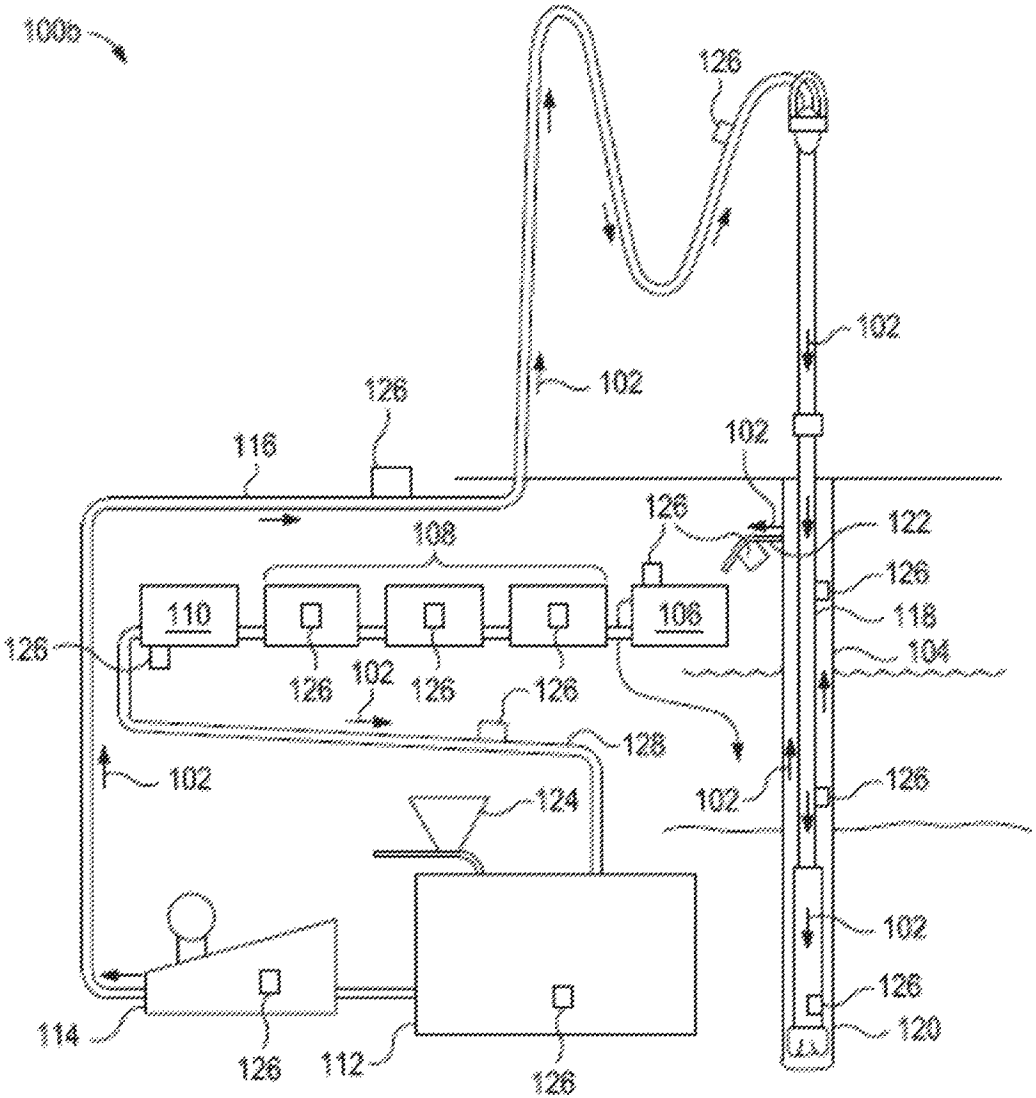

FIGS. 1A and 1B illustrate the same mud circulating system 100*a*,100*b* with different sensor placement. The drilling mud circulates per arrows 102 from the wellbore 104 through, in order, a shale shaker 106, mud cleaning components 108 (e.g., additional shakers, de-sanders, di-silters, and the like), a centrifuge 110, a mud pit 112, a mud pump 114, mud lines 116, the drill string 118, and out the drill bit 120 back into the wellbore 104. The drilling mud lubricates and cools the drill bit 120 and brings rock cuttings back to the surface through the annulus between the drill string 118 and wellbore 104. Further, the mud pit 112 is coupled to a mixer hopper 124, where the mud pit 112 received mud additive and via the mixer hopper 124. Drilling mud returning from the wellbore 104 goes through the mud return line 122 to the shale shaker 106. Large solids such as rock cuttings are removed by the shale shaker 106 and finer particles are further removed by the mud cleaning components 108 and the centrifuge 110. "Clean" mud (i.e., drilling mud with a substantial amount of cutting removed) is then stored in the mud pit 112, where chemicals are added to achieve desired fluid properties such as density and viscosity. Retreated mud is then pumped through mud lines 116 into the wellbore 104 again.

The mud circulating system 100*a* in FIG. 1A uses a traditional method of placing sensors 126 at a plurality of locations along the mud circulating system 100*a* based on cost, access, historical locations, and ease of maintenance. In the illustrated example, the mud circulating system 100*a* includes 23 sensors 126 at a plurality of locations. More specifically, there is one sensor 126 along the mud return line 122, two sensors 126 at the shale shaker 106, five sensors 126 distributed across the mud cleaning components 108, one sensor 126 at the centrifuge 110, one sensor 126 along a flow line 128 connecting the centrifuge 110 and the mud pit 112, three sensors 126 at the mud pit 112, one sensor at a flow line 130 connecting the mixer hopper 124 and the mud pit 112, three sensors 126 at the mud pump 114, three sensors 126 along the mud lines 116, and three sensors 126 downhole.

By contrast, the present application uses a local feature analysis (LFA). In such an approach, the covariance of the data from the sensors 126 forms a high-dimensional space. The state reduction approach (e.g., a local feature analysis (LFA)), may be adopted on a covariance matrix to extract the most important components of the system 100*a,b* and thus generate a low dimensional representation that is sparsely distributed and spatially localized. The extracted states may correspond to the preferred sensor locations in the mud circulation system. By measuring at the selected locations, the system's information or dynamics may be substantially to fully reconstructed (e.g., at least 75% reconstructed).

The mud circulating system 100*b* in FIG. 1B includes 12 sensors 126 with one at or along each of the mud return line 122, the shale shaker 106, each of the three mud cleaning components 108, the centrifuge 110, the flow line 128 connecting the centrifuge 110 and the mud pit 112, the mud pit 112, the mud pump 114, and the mud lines 116 and two sensors 126 downhole.

Figure 2:
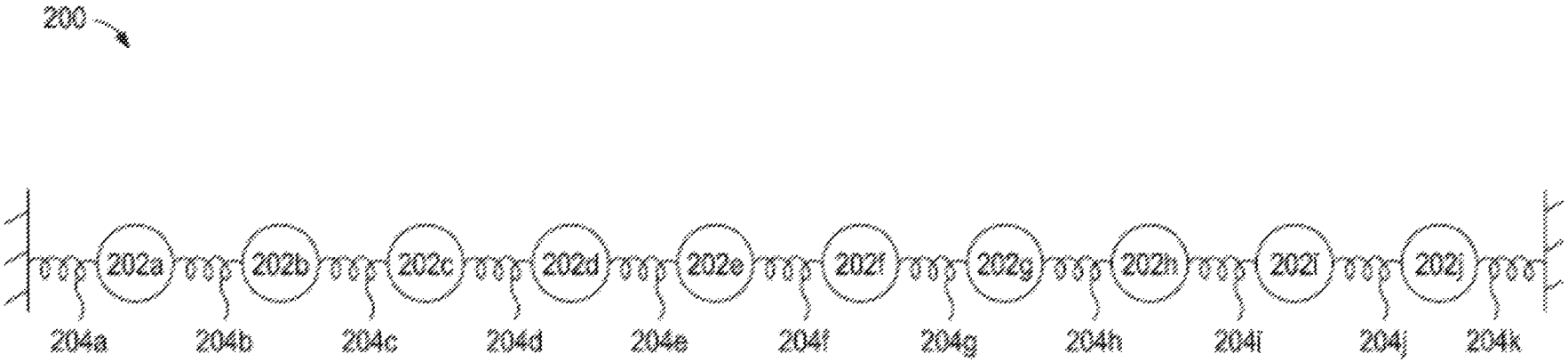
FIG. 2 gives a simple 10-mass-spring system to illustrate the concept of local feature analysis.

FIG. 2 gives a simple 10-mass-spring system 200 to illustrate the idea of LFA. Ten masses 202*a-j* in the 10-mass-spring system 200 are connected by eleven springs 204*a-k*. In the illustrated example, the spring constant for springs 204*a-c* is 500 N/m, the spring constant for springs 204*e-g* is 600 N/m, the spring constants for springs 204*i-k* is 700 N/m, and the spring constant for springs 204*d,h* is 10 N/m. The 10-mass-spring system 200 starts with initial dynamics condition so that all the masses are activated. From the construction and the existence of two small spring constants at springs 204*d,h*, the ten masses 202*a-j* comprise three dynamics group: masses 202*a-c*, masses 202*d-g*, and masses 202*h-k*. The dynamics of the 10-mass-spring system 200 were recorded for 100 time steps then fed into the LFA algorithm. The LFA identified masses 202*a-c*, masses 202*d-g*, and masses 202*h-k* as three dynamics groups, which matches the physical property of the system. Moreover, the LFA selected mass 202*c*, mass 202*f*, and mass 202*h* to represent each of the three dynamics groups and derived the dynamics relationship between the selected three masses 202*c,f,h* and all ten masses 202*a-j*. The whole system's dynamics were then reconstructed by that of the selected three masses 202*c,f,h*.

Figure 3A:
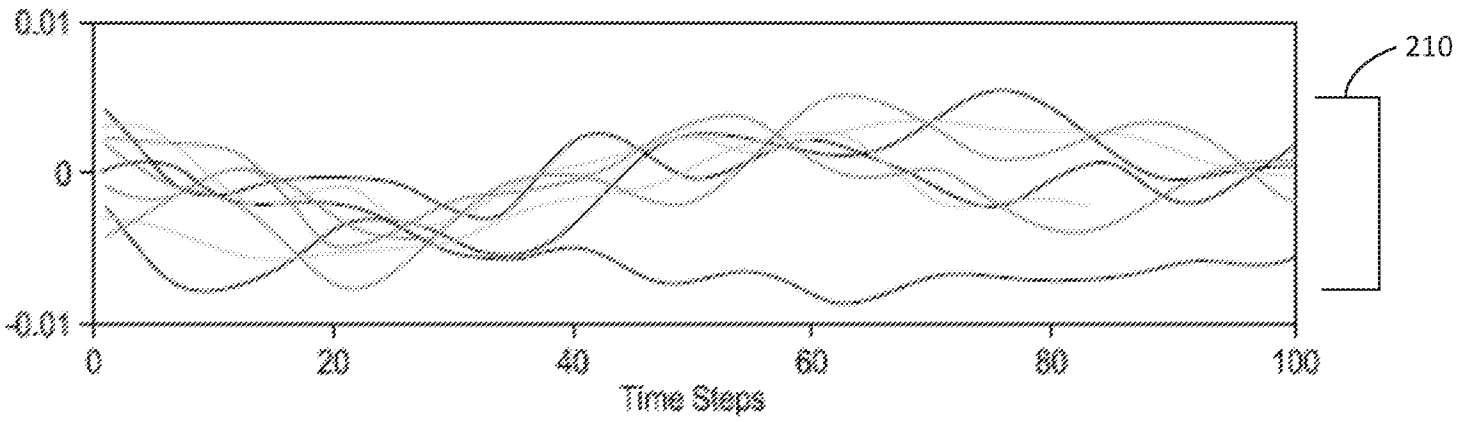
FIG. 3A illustrates the true dynamics of the system of FIG. 2.
Figure 3B:
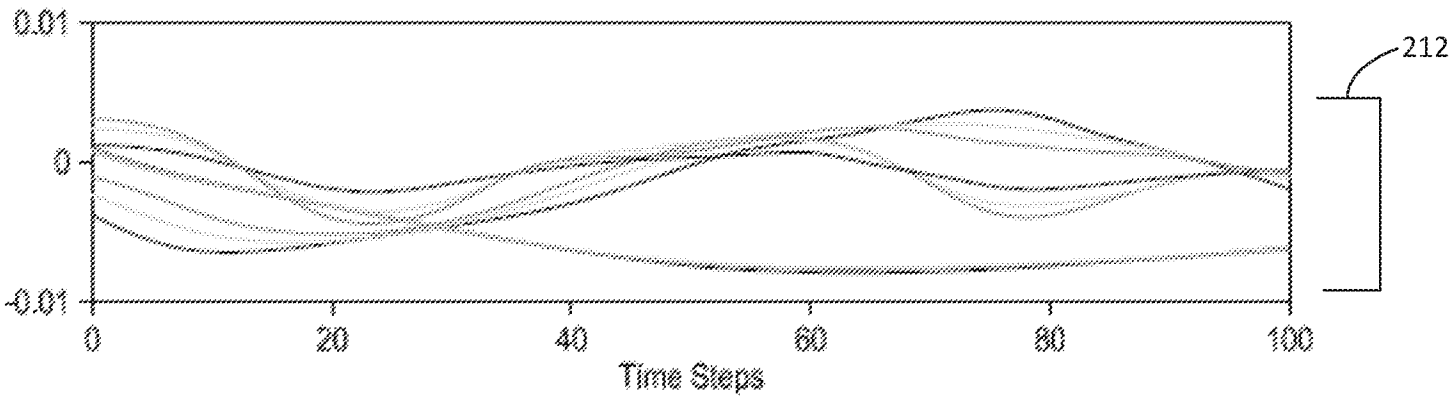
FIG. 3B illustrates the reconstructed dynamics of the system of FIG. 2.

FIG. 3*a*, with continued reference to FIG. 2, is a plot of the whole system's true dynamics (curves generally indicated by bracket 210), and FIG. 3*b* is a plot of the reconstructed dynamics (curves generally indicated by bracket 212) from the dynamics of the three masses 202*c,f,h*. In both plots each single curve represents the dynamics of one of the ten masses 202*a-j*. A comparison of FIGS. 3*a* and 3*b* illustrates that the reconstructed dynamics retains the main features of the whole system's dynamics with only limited details compromised. This example illustrates that using LFA allows the use of only a few masses 202*c,f,h* to approximate the full system's dynamics. Besides LFA other state reduction methods such as principal component analysis (PCA) and independent component analysis (ICA) may be applied in similar manner to model spatial resolution for sensors within the mud circulation system.

The modeling spatial resolution methods described herein may also be subject to various objectives such as the lowest cost required to monitor the system. The limitations of drilling environment and equipment (e.g., sensor bandwidth, maximal available sensors, power usage limitation, formation changes, and data storage and transmission capability) may also be taken into account as the constraints of the problem.

The state reduction methods may be extended to account for versatile objectives and constraints. The preferred solutions of the problem are obtained through classical linear and/or nonlinear searching algorithms. Equations (1)-(3) are an exemplary model with a simple formulation to minimize the overall prediction error covariance with a constraint on how many sensors can be used.

$$\min E=\|\Sigma_{k=1}^{m}[z(k)-\tilde{z}(k)][z(k)-\tilde{z}(k)]^T\| \quad \text{Equation (1)}$$

$$\text{s.t. } z(k)=F(y(k)) \quad \text{Equation (2)}$$

$$n\leq N_{total} \quad \text{Equation (3)}$$

where E is the error, z(k) is the mud properties being considered in the optimization, $\tilde{z}(k)$ is desired properties, T is the matrix transpose, y(k) is the measurement from the sensors, n is the number of measurements, and $N_{total}$ is the sensor limit for the current optimization.

Equation (2) shows a model that predicts a key mud property z(k) (e.g., ECD) from the measurements y(k) from the sensors (e.g., surface pressure, flow rate, viscosity, mud density, and the like, and any combination thereof). At time instant k, n suggests how many sensors are currently used for measuring $\tilde{z}(k)$ a drilling parameter value so equation (1) evaluates the accumulated prediction error based on n measurements of m time steps at certain pre-defined locations. To determine the least possible sensors, n as the cost function may be chosen and constraints imposed on the maximal acceptable prediction error.

The spatial resolution model is a systematic and effective approach to evaluate the performance of each possible sensor placement. However, due to the economic restriction, it is impossible to experimentally test the performance of all combinations. With the help of computing and an accurate dynamic model that predicts certain sensor output from available inputs, the sensor measurements of interest may be simulated and a searching algorithm may be run for preferred solutions. Consider a dynamic model of the following form:

$$x(k+1)=Ax(k)+Bu(k) \quad \text{Equation (4)}$$

$$y(k)=Cx(k)$$

where A, B, C are matrices that characterize the system dynamics, x(k) is the internal state of the model, u(k) is the input to the system, and y(k) is the output that includes all sensor location candidates.

The model may be of low order such that the associated computational effort is low. Based on that, the cost function for every possible sensor combination may be calculated by changing the output matrix C. For example, suppose there are 1000 sensor location candidates, then C is a d×1 matrix. Then, to analyze the performance of placing sensors at the $2^{nd}$, $100^{th}$ and $350^{th}$ locations, the respective rows of C together with the first equation in (4) can be taken out to simulate the sensor outputs of interest. This enables a computationally efficient way of searching for the preferred solute ions. Traditional approaches may thus be directly applied on the sensor location optimization.

Modeling Variable Resolution

Modeling the variable resolution may identify the sensor types needed to monitor the mud circulation system by identifying the drilling parameters, measurements, and sensor types that represent and/or substantially impact the fluid dynamics of the mud circulation system.

For example, a flow meter and pressure-while-drilling (PWD) sensor may be installed in the same location to monitor the flow rate, pressure, and drill string rotational speed. But the measurements from each sensor may not need to be recorded and/or transmitted simultaneously. For example, when there are stick-slip vibrations, the disclosed methods may automatically identify the rotational speed as the important parameter to transmit. In another example, when mud flow shows abnormality, the disclosed methods may suggest transmitting flow meter and PWD measurements for flow status monitoring.

Similar to modeling the spatial resolution in the last section, the state reduction method and its variations (e.g., LFA, PCA, and ICA) may be used to represent the full system with the least types and/or number of sensors.

Figure 4:
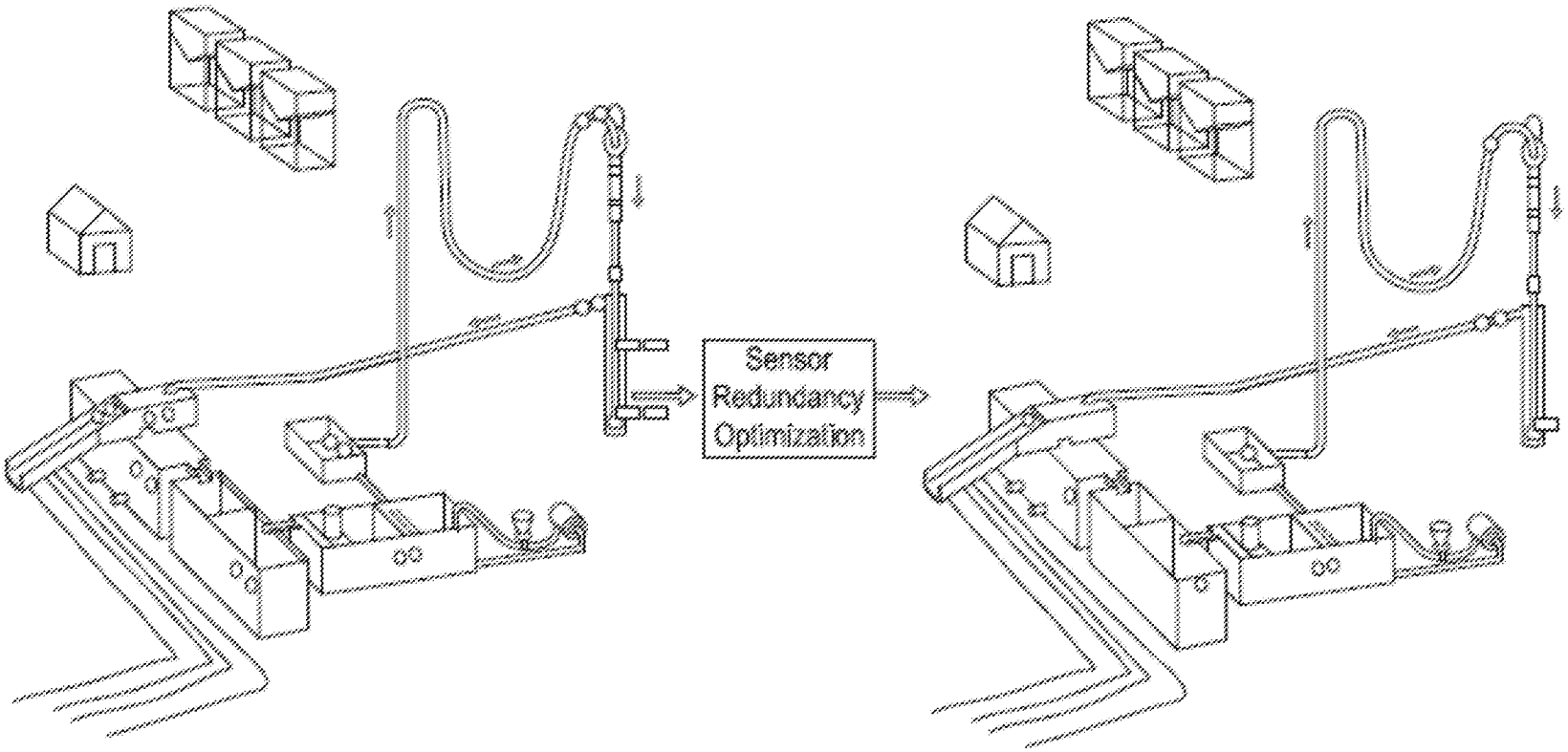
FIG. 4 illustrates a sensor redundancy modeling scheme.

The subsystems of the total mud circulation system may be physically coupled. The information from one subsystem may be transformed into data comparable to the output of other sub-systems. This provides a way to identify sensor failure by looking at the discrepancies. However, if there are dramatic dynamics changes, redundant sensors may be needed at these critical positions for sensor diagnostics. The modeling variable resolution methods may be used to find the minimal number of sensors needed with N redundancies by including the critical dynamics changes in the variable resolution method objectives. This facilitates sensor diagnostics as well as improves the sensing accuracy. The sensor redundancy modeling scheme illustrated in FIG. 4 ensures that diagnostics can be performed with confidence in an optimal way.

Modeling in Frequency Resolution

Frequency resolution modeling may dynamically select the sampling pattern (i.e., to dynamically select sensor locations or sensor types) as well as sampling intervals in different operating conditions. Frequency resolution modeling may also be fulfilled by the proposed state reduction methods described relative to spatial resolution modeling and variable resolution modeling. More specifically, the state reduction is realized through a real-time modeling framework that takes evolving well environment into account. First, assume that I sensors have been installed in the mud circulation system. At different operation points, preferred positions (which are a subset of the I locations) and their preferred sampling frequency may be recalculated. Then, only the sensors at these locations are used for measuring. As a result, when the well condition remains consistent or changes very slowly, a small amount of sparsely distributed (in sampling frequency, in spatial, or in sensor type) measurements are enough to reconstruct the mud circulation dynamics. If the well or measurements indicted a fault or experiences critical operation, dense (in temporal, in spatial, or in type) measurements close to the critical point are suggested by the control system or computer for mud monitoring and control purposes.

The same principles may also be used to select measurement data to send out. For example, where there is a significant pool of information waiting for being sent out to the monitors or controllers, only data crucial for system monitoring and control may be sent. From the sensing point of view, the most important data may be collected based on how effectively the data represents the system dynamics. From the control point of view, the most important data may be transmitted based on how dramatically the data affects the system.

Consequently, the sensor modeling methods described in this disclosure may also be applied to create a smart communication module that determines which set of data is crucial for system observation and control and adapts to the changing system dynamics.

The control systems described herein along with corresponding computer hardware used to implement the various illustrative blocks, modules, elements, components, methods, and algorithms described herein may include a processor configured to execute one or more sequences of instructions, programming stances, or code stored on a non-transitory, computer-readable medium. The processor can be, for example, a general purpose microprocessor, a microcontroller, a digital signal processor, an application specific integrated circuit, a field programmable gate array, a programmable logic device, a controller, a state machine, a gated logic, discrete hardware components, an artificial neural network, or any like suitable entity that can perform calculations or other manipulations of data. In some embodiments, computer hardware can further include elements such as, for example, a memory (e.g., random access memory (RAM), flash memory, read only memory (ROM), programmable read only memory (PROM), erasable programmable read only memory (EPROM)), registers, hard disks, removable disks, CD-ROMS, DVDs, or any other like suitable storage device or medium.

Executable sequences described herein can be implemented with one or more sequences of code contained in a memory. In some embodiments, such code can be read into the memory from another machine-readable medium. Execution of the sequences of instructions contained in the memory can cause a processor to perform the process steps described herein. One or more processors in a multi-processing arrangement can also be employed to execute instruction sequences in the memory. In addition, hard-wired circuitry can be used in place of or in combination with software instructions to implement various embodiments described herein. Thus, the present embodiments are not limited to any specific combination of hardware and/or software.

As used herein, a machine-readable medium will refer to any medium that directly or indirectly provides instructions to a processor for execution. A machine-readable medium can take on many forms including, for example, non-volatile media, volatile media, and transmission media. Non-volatile media can include, for example, optical and magnetic disks. Volatile media can include, for example, dynamic memory. Transmission media can include, for example, coaxial cables, wire, fiber optics, and wires that form a bus. Common forms of machine-readable media can include, for example, floppy disks, flexible disks, hard disks, magnetic tapes, other like magnetic media, CD-ROMs, DVDs, other like optical media, punch cards, paper tapes and like physical media with patterned holes, RAM, ROM, PROM, EPROM and flash EPROM.

Embodiments described herein include, but are not limited to, Embodiment A, Embodiment B, and Embodiment C.

Embodiment A is a method comprising: circulating a mud through a mud circulation system that includes a plurality of sensors that include at least one of: a pressure sensor, a stroke counter, a flow sensor, a viscosity sensor, or density sensor; and modeling the plurality of sensors using a state reduction approach to determine at least one selected from the group consisting of preferred locations, preferred sensory types, preferred sensor frequency resolution, and a combination thereof that effectively represent or substantially impact conditions of the mud circulation system, thereby providing a preferred sensor scheme.

Embodiment B is a mud circulation system comprising: a drill string extending into a wellbore penetrating into a subterranean formation; a pump fluidly coupled to the drill string for circulating mud through the mud circulation system; and a plurality of sensors in a preferred sensor scheme; and a non-transitory computer-readable medium communicably coupled to the plurality of sensors to receive a plurality of measurements therefrom and encoded with instructions that, when executed, cause the system to perform a method comprising: modeling the plurality of sensors using a state reduction approach to determine at least one selected from the group consisting of preferred locations, preferred sensory types, preferred sensor frequency resolution, and a combination thereof that effectively represent or substantially impact conditions of the mud circulation system, thereby providing the preferred sensor scheme Embodiment C is a non-transitory computer-readable medium encoded with instructions that, when executed, cause a mud circulation system to perform a method comprising: modeling a plurality of sensors using a state reduction approach to determine at least one selected from the group consisting of preferred locations, preferred sensory types, preferred sensor frequency resolution, and a combination thereof that effectively represent or substantially impact conditions of the mud circulation system, thereby providing a preferred sensor scheme, wherein the plurality of sensors include at least one of: a pressure sensor, a stroke counter, a flow sensor, a viscosity sensor, or density sensor Embodiments A, B, and C may optionally include at least one of the following: Element 1: wherein the operation parameters of the pump include at least one of: pump rate or rate of change of pump rate; Element 2: wherein the state reduction approach is a local feature analysis; Element 3: wherein the state reduction approach is a principal component analysis; Element 4: wherein the state reduction approach is an independent component analysis; Element 5: wherein the mud circulation system is a virtual mud circulation system; Element 6: Element 5 and the method further comprising: implementing the preferred sensor scheme in a wellbore penetrating a subterranean formation; Element 7: the method further comprising: circulating the mud through the mud circulation system; and collecting measurements from the sensors of the preferred sensor scheme. Exemplary combinations may include, but are not limited to, one of Elements 2-4 in combination with Element 1; one of Elements 2-4 in combination with Element 5 and optionally Element 6; one of Elements 2-4 in combination with Element 7; Element 1 in combination with Element 5 and optionally Element 6; Element 1 in combination with Element 7; and combinations thereof.

Numerous other variations and modifications will become apparent to those skilled in the art once the above disclosure is fully appreciated. It is intended that the following claims be interpreted to embrace all such variations, modifications and equivalents. In addition, the term "or" should be interpreted in an inclusive sense.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the embodiments of the present invention. At the very least, and not as an attempt to limit the application of the doctrine of equivalents to the scope of the claim, each numerical parameter should at least be construed in light of the number of reported significant digits and by applying ordinary rounding techniques.

One or more illustrative embodiments incorporating the invention embodiments disclosed herein are presented herein. Not all features of a physical implementation are described or shown in this application for the sake of clarity. It is understood that in the development of a physical embodiment incorporating the embodiments of the present invention, numerous implementation-specific decisions must be made to achieve the developer's goals, such as compliance with system-related, business-related, government-related and other constraints, which vary by implementation and from time to time. While a developer's efforts might be time-consuming, such efforts would be, nevertheless, a routine undertaking for those of ordinary skill in the art and having benefit of this disclosure.

While compositions and methods are described herein in terms of "comprising" various components or steps, the compositions and methods can also "consist essentially of" or "consist of" the various components and steps.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

The following is claimed:

1. A method comprising:

circulating a mud through a mud circulation system that includes a plurality of sensors that include at least one of: a pressure sensor, a stroke counter, a flow sensor, a viscosity sensor, or density sensor; and modeling the plurality of sensors using a state reduction approach adopted on a covariance matrix to extract one or more states of the mud circulation system corresponding to at least one selected from the group consisting of preferred locations, preferred sensory types, preferred sensor frequency resolution, and a combination thereof; and providing a preferred sensor scheme for the mud circulation system based on the modeling of the plurality of sensors.

2. The method of claim 1, wherein the mud circulation system comprises a pump, and wherein one or more operation parameters of the pump include at least one of: pump rate or rate of change of pump rate.

3. The method of claim 1, wherein the state reduction approach is a local feature analysis.

4. The method of claim 1, wherein the state reduction approach is a principal component analysis.

5. The method of claim 1, wherein the state reduction approach is an independent component analysis.

6. The method of claim 1, wherein the mud circulation system is a virtual mud circulation system.

7. The method of claim 6 further comprising: implementing the preferred sensor scheme in a wellbore penetrating a subterranean formation.

8. The method of claim 1 further comprising: circulating the mud through the mud circulation system; and collecting measurements from the sensors of the preferred sensor scheme.

9. A mud circulation system comprising:

a drill string extending into a wellbore penetrating into a subterranean formation;

a pump fluidly coupled to the drill string for circulating mud through the mud circulation system;

a plurality of sensors in a preferred sensor scheme; and a non-transitory computer-readable medium communicably coupled to the plurality of sensors to receive a plurality of measurements therefrom and encoded with instructions that, when executed, cause the system to perform a method comprising:

modeling the plurality of sensors using a state reduction approach adopted on a covariance matrix to extract one or more states of the mud circulation system corresponding to at least one selected from the group consisting of preferred locations, preferred sensory types, preferred sensor frequency resolution, and a combination thereof; and providing the preferred sensor scheme for the mud circulation system based on the modeling of the plurality of sensors.

10. The mud circulation system of claim 9, wherein one or more operation parameters of the pump include at least one of: pump rate or rate of change of pump rate.

11. The mud circulation system of claim 9, wherein the state reduction approach is a local feature analysis.

12. The mud circulation system of claim 9, wherein the state reduction approach is a principal component analysis.

13. The mud circulation system of claim 9, wherein the state reduction approach is an independent component analysis.

14. The mud circulation system of claim 9, wherein the modeling of the mud circulation system is based at least in part on a virtual mud circulation system.

15. A non-transitory computer-readable medium encoded with instructions that, when executed, cause a mud circulation system to perform a method comprising:

modeling a plurality of sensors using a state reduction approach adopted on a covariance matrix to extract one or more states of the mud circulation system corresponding to at least one selected from the group consisting of preferred locations, preferred sensory types, preferred sensor frequency resolution, and a combination thereof, and providing a preferred sensor scheme for the mud circulation system based on the modeling of the plurality of sensors, wherein the plurality of sensors includes at least one of: a pressure sensor, a stroke counter, a flow sensor, a viscosity sensor, or density sensor.

16. The non-transitory computer-readable medium of claim 15, wherein the mud circulation system comprises a pump, and wherein one or more operation parameters of the pump include at least one of: pump rate or rate of change of pump rate.

17. The non-transitory computer-readable medium of claim 15, wherein the state reduction approach is a local feature analysis.

18. The non-transitory computer-readable medium of claim 15, wherein the state reduction approach is a principal component analysis.

19. The non-transitory computer-readable medium of claim 15, wherein the state reduction approach is an independent component analysis.

20. The non-transitory computer-readable medium of claim 15, wherein the mud circulation system is a virtual mud circulation system.

* * * * *